US009598805B2

(12) United States Patent
Toyomi et al.

(10) Patent No.: US 9,598,805 B2
(45) Date of Patent: Mar. 21, 2017

(54) PRESSER FOOT FOR SEWING MACHINE

(71) Applicant: JANOME SEWING MACHINE Co., Ltd., Hachioji-shi, Tokyo (JP)

(72) Inventors: Chiyo Toyomi, Hachioji (JP); Yasuhiro Osanai, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 0 days.

(21) Appl. No.: 15/063,261

(22) Filed: Mar. 7, 2016

(65) Prior Publication Data

US 2016/0281287 A1 Sep. 29, 2016

(30) Foreign Application Priority Data

Mar. 27, 2015 (JP) ..... 2015-067700

(51) Int. Cl.
*D05B 29/12* (2006.01)

(52) U.S. Cl.
CPC ..... *D05B 29/12* (2013.01)

(58) Field of Classification Search
CPC ..... D05B 9/06; D05B 29/08; D05B 29/12
USPC ..... 112/235, 240
See application file for complete search history.

(56) References Cited

U.S. PATENT DOCUMENTS 202,303 A * 4/1878 Trowbridge ..... D05B 35/06 112/152
1,147,960 A * 7/1915 Mathewson ..... D05B 29/06 112/235
1,501,901 A * 7/1924 Gatchell ..... D05B 29/08 112/235
1,794,022 A * 2/1931 Levinson ..... D05B 29/00 112/134
3,026,837 A * 3/1962 Enos ..... D05B 29/00 112/236
3,145,674 A * 8/1964 Kurihara ..... D05B 29/12 112/240
3,270,695 A * 9/1966 Ross ..... D05B 29/12 112/240
3,326,160 A * 6/1967 Murino ..... D05B 29/12 112/240
3,511,199 A * 5/1970 Howell ..... D05B 3/18 112/235

(Continued)

FOREIGN PATENT DOCUMENTS

JP 2000-233088 A 8/2000

*Primary Examiner* — Danny Worrell
(74) *Attorney, Agent, or Firm* — McGinn IP Law Group, PLLC

(57) ABSTRACT

A presser foot for a sewing machine, is attached to a lower end of a presser bar to press a fabric during sewing, the presser bar being supported by the sewing machine so as to be slidable in an up-down direction. An attachment shaft member is provided in the presser bar so as to be slidable, the attachment shaft member attaching the presser foot so as to be detachable from the presser bar, and an attachment portion is provided in the presser foot so as to be fixed to the lower end of the presser bar by the attachment shaft member. The attachment shaft member includes a holding shaft portion that holds the attachment portion in the presser bar, and two positioning shaft portions having different shaft diameters smaller than that of the holding shaft portion.

10 Claims, 4 Drawing Sheets

VIEW ALONG ARROW Y1-Y1

(56) References Cited

U.S. PATENT DOCUMENTS

| | | | | | |
|---|---|---|---|---|---|
| 3,724,407 | A * | 4/1973 | Simon | D05B 29/06 | 112/240 |
| 3,973,508 | A * | 8/1976 | Eguchi | D05B 29/06 | 112/240 |
| 4,178,865 | A * | 12/1979 | Odermann | D05B 83/00 | 112/240 |
| 4,212,256 | A * | 7/1980 | Jimenez | D05B 29/08 | 112/240 |
| 4,385,576 | A * | 5/1983 | Marsh | D05B 29/12 | 112/240 |
| 4,492,173 | A * | 1/1985 | Hirose | D05B 29/12 | 112/240 |
| 4,848,257 | A * | 7/1989 | Lee | D05B 29/10 | 112/235 |
| 5,050,515 | A * | 9/1991 | Lawrie | D05B 29/12 | 112/235 |
| 5,676,075 | A * | 10/1997 | Chen | D05B 29/12 | 112/240 |
| 5,749,311 | A * | 5/1998 | Kobayashi | D05B 29/06 | 112/240 |
| 2012/0097085 | A1* | 4/2012 | Fukao | D05B 29/12 | 112/240 |

* cited by examiner

Fig. 1A
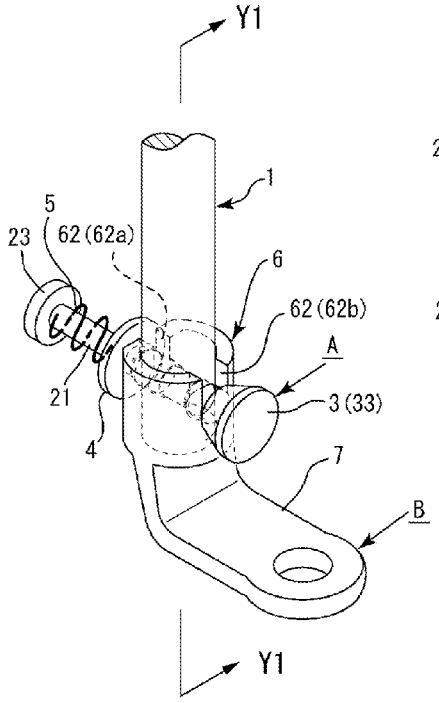
Fig. 1B
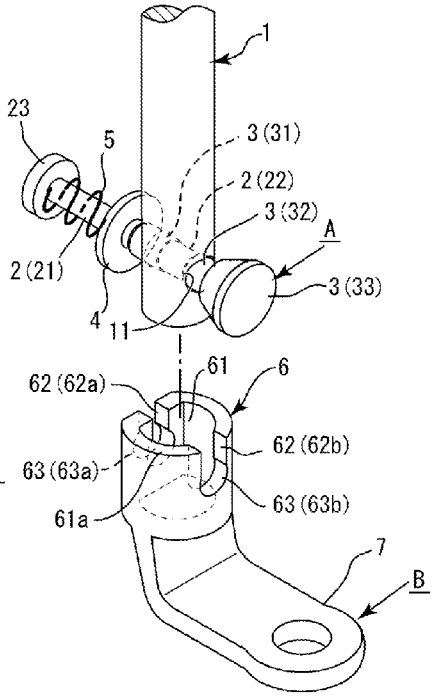
Fig. 1C
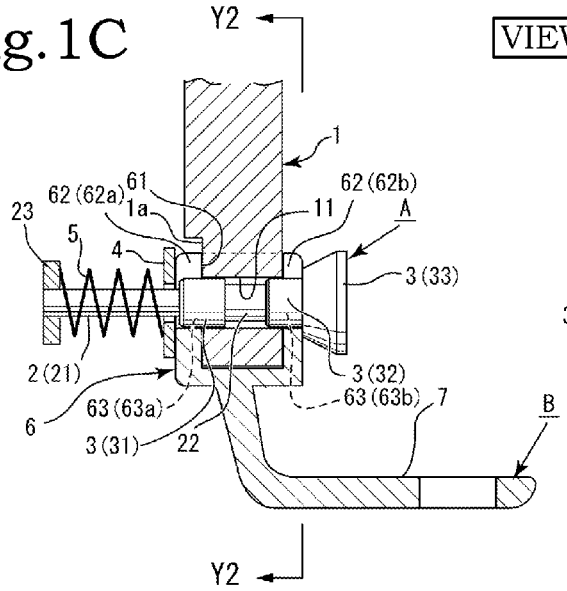
VIEW ALONG ARROW Y1-Y1
VIEW ALONG ARROW Y2-Y2
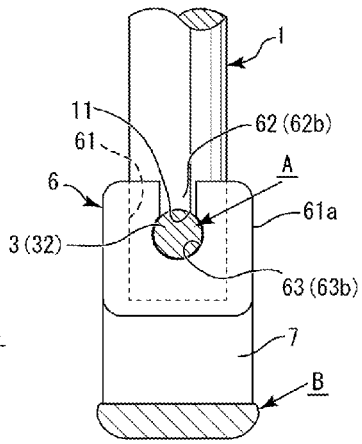
Fig. 1D Fig.2A
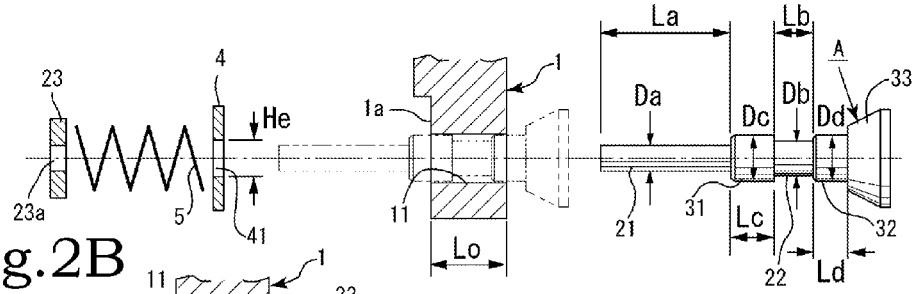
Fig.2B
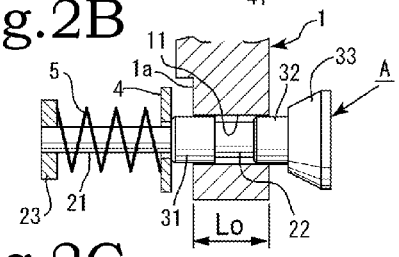
VIEW ALONG ARROW X1-X1
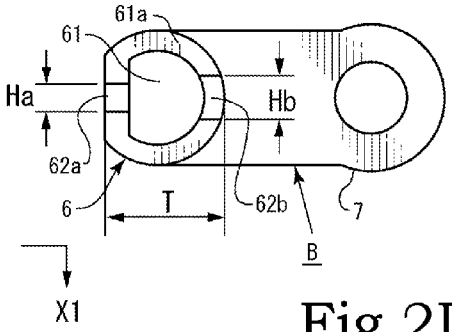
Fig.2D
Fig.2C
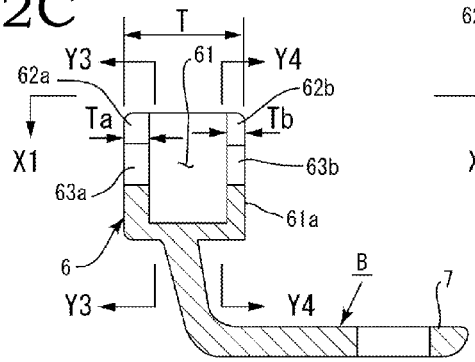
Fig.2E
VIEW ALONG ARROW Y4-Y4
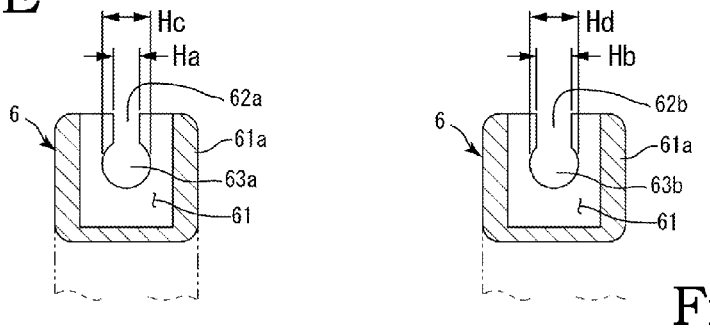
Fig.2F
VIEW ALONG ARROW Y3-Y3

PRESSER FOOT FOR SEWING MACHINE

BACKGROUND OF THE INVENTION

1. Field of the Invention

The present invention relates to a presser foot for a sewing machine which can be operated easily by allowing a presser foot holder and an embroidery presser foot to be attached and detached to and from a presser bar with one touch.

2. Description of the Related Art

Conventionally, users have to attach and detach a presser foot using a fastening screw to replace the presser foot according to the purpose whenever normal stitching and embroidery stitching are performed. Thus, users have to fasten and loosen the fastening screw to attach and detach the presser foot to and from a presser bar.

SUMMARY OF THE INVENTION

Japanese Patent Application Publication No. 2000-233088 discloses a technique in which a screw member is fastened and loosened to attach and detach a presser foot as described above. Moreover, the screw may be loosened due to vibration during operation of a sewing machine. Moreover, when the screw is fastened too tightly, a dedicated tool such as a driver is required when loosening the screw and such an operation is extremely troublesome.

Therefore, an object of the present invention is to provide a presser foot holder for a sewing machine or a presser foot for an embroidery sewing machine which can be operated easily by allowing a presser foot holder and an embroidery presser foot to be attached and detached to and from a presser bar with one touch.

As a result of intensive studies to solve the above problems, the present inventor solved the problems by providing, as a first embodiment of the present invention, a presser foot for a sewing machine, attached to a lower end of a presser bar to press a fabric during sewing, the presser bar being supported by the sewing machine so as to be slidable in an up-down direction, wherein an attachment shaft member is provided in the presser bar so as to be slidable, the attachment shaft member attaching the presser foot so as to be detachable from the presser bar, an attachment portion is provided in the presser foot so as to be fixed to the lower end of the presser bar by the attachment shaft member, the attachment shaft member includes a holding shaft portion that holds the attachment portion in the presser bar, and two positioning shaft portions having different shaft diameters smaller than that of the holding shaft portion, and an attachment direction of the presser foot is restricted by providing, in the attachment portion of the presser foot, slits continuous with holding holes in which the holding shaft portion can be inserted and having widths corresponding to the different shaft diameters of the positioning shaft portions of the attachment shaft member.

A second embodiment of the present invention solves the problems by the presser foot for a sewing machine according to the first embodiment, in which a first positioning shaft portion, a first holding shaft portion, a second positioning shaft portion, and a second holding shaft portion are continuously formed in the attachment shaft member in that order in an axial direction, a terminal portion is formed at an outer shaft end of the first positioning shaft portion, and a knob is provided at an outer shaft end of the second holding shaft portion, and the slits include a first slit having a width such that the first positioning shaft portion can be inserted, and a second slit having a width such that the second positioning shaft portion can be inserted.

A third embodiment of the present invention solves the problems by the presser foot for a sewing machine according to the first or second embodiment, in which an elastic biasing member is formed as a coil spring in which the first positioning shaft portion is inserted in an axial direction. A fourth embodiment of the present invention solves the problems by the presser foot for a sewing machine according to the second or third embodiment, in which the knob is formed in a truncated conical shape such that a diameter thereof decreases as it advances from an outer end toward an inner end.

In the first and second embodiments of the present invention, when the attachment shaft member attached to the through-hole portion of the presser bar is moved in the axial direction, the attachment shaft member can be operated to a state in which the first and second positioning shaft portions or the first and second holding shaft portions protrude from both openings of the through-hole portion. The attachment portion in which the lower portion of the presser bar is inserted is provided in the presser foot. Further, the first slit in which the first positioning shaft portion only can be inserted and the second slit in which the second positioning shaft portion only can be inserted are formed in the attachment portion. The first and second holding holes are continuously formed at the lower ends of the first and second slits, respectively.

Due to such a configuration, when an operation of moving the attachment shaft member in the axial direction is performed, a state in which the first and second positioning shaft portions protrude from the lower end of the presser bar is created. In this state, the presser foot is raised from a position lower than the lower end of the presser bar while aligning the first slit of the attachment portion of the presser foot with the position of the first positioning shaft portion and aligning the second slit with the position of the second positioning shaft portion.

In this way, the first positioning shaft portion can be moved to the position of the first holding hole and the second positioning shaft portion can be moved to the position of the second holding hole. Further, by moving the attachment shaft member in the axial direction, the first holding shaft portion can be inserted in the first holding hole and the second holding shaft portion can be inserted in the second holding hole. Further, this state is maintained by the knob provided in the second holding shaft portion together with the elastic member. In this manner, the presser foot can be attached to the presser bar almost immediately without using screws, dedicated tools or the like.

Further, the first and second positioning shaft portions have different diameters, and the first and second slits have different configurations corresponding to the different diameters of the first and second positioning shaft portions. Thus, when the presser foot is attached in a wrong direction so that the first positioning shaft portion corresponds to the second slit and the second positioning shaft portion corresponds to the first slit, any one of the pairs cannot be inserted. As a result, it is possible to prevent an attachment error of the presser foot to the presser bar.

BRIEF DESCRIPTION OF THE DRAWINGS

FIG. 1A is a perspective view illustrating a state in which a presser foot is attached to a presser bar according to the present invention, FIG. 1B is a perspective view illustrating a state in which the presser foot is separated from the presser bar according to the present invention, FIG. 1C is a cross-sectional view along arrow Y1-Y1 in FIG. 1A, and FIG. 1D is a cross-sectional view along arrow Y2-Y2 in FIG. 1C.

FIG. 2A is a side view of a partial cross-section, illustrating a state in which the presser bar is disassembled from an attachment shaft member, FIG. 2B is a side view of a partial cross-section, illustrating a state in which the presser bar and the attachment shaft member are assembled together, FIG. 2C is a longitudinal cross-sectional view of the presser foot, FIG. 2D is a cross-sectional view along arrow X1-X1 in FIG. 2C, FIG. 2E is a cross-sectional view along arrow Y3-Y3 in FIG. 2C, and FIG. 2F is a cross-sectional view along arrow Y4-Y4 in FIG. 2C.

FIG. 4B is a cross-sectional view along arrow Y7-Y7 in FIG. 4A, FIG. 4C is a cross-sectional view along arrow Y8-Y8 in FIG. 4A, FIG. 4D is a side view of a partial cross-section, illustrating a state in which attachment of the presser foot to the presser bar is completed, FIG. 4E is a cross-sectional view along arrow Y9-Y9 in FIG. 4D, and FIG. 4F is a cross-sectional view along arrow Y10-Y10 in FIG. 4D.

DESCRIPTION OF THE PREFERRED EMBODIMENTS

Figure 3A:
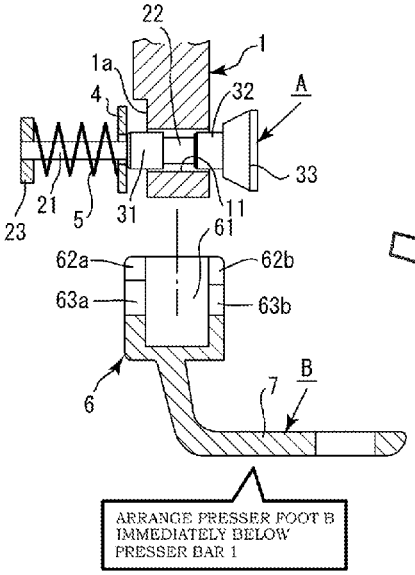
FIG. 3A is a side view of a partial cross-section, illustrating a process of attaching the presser foot to the presser bar according to the present invention.

Hereinafter, an embodiment of the present invention will be described with reference to the drawings. The present invention includes a presser bar 1, an attachment shaft member A, an elastic biasing member 5, a washer 4, and a presser foot B (see FIGS. 1A to 1D). A portion (for example, approximately ⅓) in a radial direction of the presser bar 1, of a side surface at a lower end of the presser bar 1 is cut. A cross-section orthogonal in an axial direction of the presser bar 1 has an approximate D-shape. The lower end of the presser bar 1 is flat along the axial direction to form a flat surface 1*a*.

A through-hole portion 11 is formed in a lower portion of the presser bar 1, and the attachment shaft member A (described later) is inserted in the through-hole portion 11 (see FIGS. 1C and 1D). The through-hole portion 11 has a hole passage formed along a direction orthogonal to the flat surface la and an opening of the through-hole portion 11 is present in the flat surface 1*a*.

The attachment shaft member A includes a positioning shaft portion 2 and a holding shaft portion 3. The positioning shaft portion 2 includes a first positioning shaft portion 21 and a second positioning shaft portion 22, and the holding shaft portion 3 includes a first holding shaft portion 31 and a second holding shaft portion 32. The first positioning shaft portion 21, the first holding shaft portion 31, the second positioning shaft portion 22, and the second holding shaft portion 32 are continuously formed in that order in the axial direction (see FIG. 1C and FIGS. 2A and 2B). Specifically, the second positioning shaft portion 22 is positioned between the first holding shaft portion 31 and the second holding shaft portion 32, and the first positioning shaft portion 21 is formed at an outer shaft end of the first holding shaft portion 31.

The first positioning shaft portion 21, the first holding shaft portion 31, the second positioning shaft portion 22, and the second holding shaft portion 32 are configured such that the cross-sections orthogonal to the axial direction thereof are circular and the respective centers in the radial direction thereof are aligned on a shaft center line along the axial direction (see FIGS. 2A and 2B).

The first positioning shaft portion 21 is formed longer than the other shape holding portions (the first holding shaft portion 31, the second positioning shaft portion 22, and the second holding shaft portion 32). The second positioning shaft portion 22 is positioned between the first holding shaft portion 31 and the second holding shaft portion 32. The diameter Db of the second positioning shaft portion 22 is larger than the diameter Da of the first positioning shaft portion 21 and is smaller than the diameter Dc of the first holding shaft portion 31 and the diameter Dd of the second holding shaft portion 32.

The diameter Dc of the first holding shaft portion 31 is the same as the diameter Dd of the second holding shaft portion 32 (see FIG. 2A). Moreover, the diameter Db of the second positioning shaft portion 22 may be the same as the diameter Da of the first positioning shaft portion 21. Further, the diameter Dc of the first holding shaft portion 31 may be different from the diameter Dd of the second holding shaft portion 32.

The washer 4 is attached to the first positioning shaft portion 21 of the attachment shaft member A (see FIGS. 2A and 2B). The washer 4 has a disk shape and a through-hole 41 is formed at a radial center thereof. The inner diameter He of the through-hole 41 is larger than the diameter Da of the first positioning shaft portion 21, and the first positioning shaft portion 21 can be inserted in the through-hole 41 with play. That is, the washer 4 can freely slide in relation to the first positioning shaft portion 21.

The inner diameter He of the through-hole 41 of the washer 4 is smaller than the diameter of the first holding shaft portion 31 adjacent to the first positioning shaft portion 21. Due to this, the washer 4 serves as a stopper that allows the washer 4 to slide in the axial direction of the first positioning shaft portion 21 only and stops the washer 4 at the shaft end of the first holding shaft portion 31. An elastic biasing member 5 is attached to the first positioning shaft portion 21 together with the washer 4.

Specifically, a coil spring is used as the elastic biasing member 5 (see FIGS. 1A to 1C, FIGS. 2A and 2B, and the like). The first positioning shaft portion 21 is configured to be inserted in the axial direction in relation to the coil spring. One end in the axial direction of the elastic biasing member 5 makes contact with the washer 4. A terminal member 23 is attached to an outer axial end of the first positioning shaft portion 21.

The terminal member 23 is an annular member having an appropriate thickness and a through-hole 23*a* is formed at a radial center position thereof. The outer axial end of the first positioning shaft portion 21 is fixed to the through-hole 23*a* by fixing means such as press-fitting, and the terminal member 23 is attached to the first positioning shaft portion 21. The elastic biasing member 5 is configured such that both axial ends thereof are sandwiched by the washer 4 and the terminal member 23. When the washer 4 slides in the axial direction in relation to the first positioning shaft portion 21, the elastic biasing member 5 which is a coil spring expands and contracts in the axial direction (see FIG. 2B).

A knob 33 is provided at an outer shaft end of the second holding shaft portion 32 (see FIGS. 2A and 2B). The knob 33 is formed in a truncated conical shape such that the diameter thereof gradually decreases from an outer axial end of the second holding shaft portion 32 toward an inner axial end. The attachment shaft member A is attached to the presser bar 1 with the through-hole portion 11 of the presser bar 1 interposed.

The through-hole portion 11 is configured such that the first and second holding shaft portions 31 and 32 of the attachment shaft member A can be inserted and can slide. That is, the inner diameter Hf of the through-hole portion 11 is larger than the diameter Dc of the first holding shaft portion 31 and the diameter Dd of the second holding shaft portion 32. However, the difference is small and is set such that wobbling rarely occurs when the attachment shaft member A slides in the axial direction in relation to the through-hole portion 11.

Since the attachment shaft member A is configured to freely slide in relation to the through-hole portion 11 of the presser bar 1, the attachment shaft member A can be operated to either a state (see FIG. 3C) in which the first and second positioning shaft portions 21 and 22 both protrude from the position of the through-hole portion 11 of the presser bar 1 or a state (see FIG. 2B and FIGS. 3A and 3B) in which the first and second holding shaft portions 31 and 32 both protrude from the position of the through-hole portion 11.

Specifically, portions of the first and second holding shaft portions 31 and 32 both protrude from the position at which the through-hole portion 11 of the presser bar 1 is formed and the other portions both are inserted in the through-hole portion 11 (see FIG. 2B). Moreover, when the first and second positioning shaft portions 21 and 22 protrude from the position at which the through-hole portion 11 of the presser bar 1 is formed, the first holding shaft portion 31 is inserted in the through-hole portion 11 (see FIG. 3C).

That is, when the attachment shaft member A slides in relation to the through-hole portion 11, the shaft centers of the first positioning shaft portion 21, the second positioning shaft portion 22, the first holding shaft portion 31, and the second holding shaft portion 32 always maintain a state of being approximately identical to the radial center of the through-hole portion 11, and the respective shaft centers do not shake when the attachment shaft member A slides.

Here, in order to satisfy the above conditions, the length Lb in the axial direction of the second positioning shaft portion 22 is smaller than the length Lo of the hole passage of the through-hole portion 11.

That is, $Lb<Lo$.

Moreover, the length Lc in the axial direction of the first holding shaft portion 31 is equal to or smaller than the length Lo of the hole passage of the through-hole portion 11.

That is, $Lc \leq Lo$.

The presser foot B includes an attachment portion 6 and a pressing portion 7 (see FIGS. 1B and FIGS. 2C and 2D). The attachment portion 6 is a portion which is connected to the presser bar 1 so that the presser foot B is attached thereto, and an insertion room 61 in which the lower portion of the presser bar 1 is inserted is formed. The insertion room 61 has an approximately cylindrical peripheral wall 61*a*. A cross-section orthogonal to an up-down direction of the peripheral wall 61*a* has a D-shape which is identical to the shape of the cross-section of the lower portion of the presser bar 1 and in which a portion of the cross-section is a flat surface (see FIG. 2D).

The peripheral wall 61*a* of the attachment portion 6 includes two slits 62 and two holding holes 63 continuous with the slits 62. The slit 62 includes a first slit 62*a* corresponding to the first positioning shaft portion 21 of the attachment shaft member A and a second slit 62*b* corresponding to the second positioning shaft portion 22. The first and second slits 62*a* and 62*b* have different groove widths corresponding to the different shaft diameters of the first and second positioning shaft portions 21 and 22. The holding hole 63 includes a first holding hole 63*a* and a second holding hole 63*b* corresponding to the first holding shaft portion 31 and the second holding shaft portion 32 of the attachment shaft member A. The first holding hole 63*a* is formed continuously at the lower end of the first slit 62*a* and the second holding hole 63*b* is formed continuously at the lower end of the second slit 62*b* (see FIG. 1B and FIGS. 2C, 2E, and 2F).

The first and second slits 62*a* and 62*b* are formed at positions of the approximately cylindrical peripheral wall 61*a*, at which the slits face each other. The first slit 62*a* has a width Ha such that the first positioning shaft portion 21 can be inserted in the first slit 62*a*, and the second slit 62*b* has a width Hb such that the second positioning shaft portion 22 can be inserted in the second slit 62*b*.

The first holding hole 63*a* is integrally and continuously formed so as to communicate with the first slit 62*a*, and similarly, the second holding hole 63*b* is integrally and continuously formed so as to communicate with the second slit 62*b* (see FIG. 1B and FIGS. 2C, 2E, and 2F).

The first holding hole 63*a* has an inner diameter Hc such that the first holding shaft portion 31 of the attachment shaft member A can be inserted in the first holding hole 63*a*, and the second holding hole 63*b* has an inner diameter Hd such that the second holding shaft portion 32 can be inserted in the second holding hole 63*b*. The diameter Dc of the first holding shaft portion 31 is larger than the width Ha of the first slit 62*a* so that the first holding shaft portion 31 cannot be inserted in the first slit 62*a*. Moreover, the diameter Dd of the second holding shaft portion 32 is larger than the width Hd of the second slit 62*b* so that the second holding shaft portion 32 cannot be inserted in the second slit 62*b*.

That is, $Dc>Ha$ and $Dd>Hb$.

Due to the above-described configuration, the presser foot B is not removed from the presser bar 1 in a state in which the lower portion of the presser bar 1 is inserted in the insertion room 61, the first holding shaft portion 31 is inserted in the first holding hole 63*a*, and the second holding shaft portion 32 is inserted in the second holding hole 63*b*.

The thickness Tb of the peripheral wall 61*a* of the presser foot B at a position at which the second slit 62*b* is formed is smaller than the length Ld in the axial direction of the second holding shaft portion 32.

That is, $Tb<Ld$.

Due to this, when the presser foot B is attached to the presser bar 1, a portion of the second holding shaft portion 32 is always present in the through-hole portion 11 and a stable attachment state can be realized.

An external dimension on the outer surface side of the peripheral wall 61*a* at the positions of the first and second slits 62*a* and 62*b* of the attachment portion 6 of the presser foot B is defined as T. The external dimension T is the sum of the thickness Ta at the first slit 62*a*, of the peripheral wall 61*a* of the attachment portion 6, the thickness Tb at the second slit 62*b* of the peripheral wall 61*a*, and the length Lo of the hole passage of the through-hole portion 11 of the presser bar 1 (see FIGS. 2B and 2C).

That is, T=Ta+Tb+Lo.

The external dimension T is set larger than a total length (Lb+Lc+Ld) in the axial direction of the first holding shaft portion 31, the second positioning shaft portion 22, and the second holding shaft portion 32.

That is, T>(Lb+Lc+Ld). However, the difference may be small.

Due to the above-described dimensional relation, in a state in which the presser foot B is attached to the presser bar 1, the peripheral wall 61*a* close to the first slit 62*a* of the attachment portion 6 can be elastically biased and fixed to the lower portion of the presser bar 1 with the aid of the washer 4 and the elastic biasing member 5 provided in the first positioning shaft portion 21. That is, the elastic force of the elastic biasing member 5 enables the attachment portion 6 to be pressed and fixed to the presser bar 1. The pressing portion 7 of the presser foot B is formed integrally with the attachment portion 6. Various pressing portions 7 are present depending on the purpose such as normal stitching and embroidery.

Next, operation steps for attaching the presser foot B to the presser bar 1 will be described. First, the first and second holding shaft portions 31 and 32 of the attachment shaft member A attached to the through-hole portion 11 of the presser bar 1 protrude from both openings of the through-hole portion 11 and the second positioning shaft portion 22 is received in the through-hole portion 11 (see FIG. 3A).

First, the presser foot B is disposed immediately below the presser bar 1 (see FIG. 3A). In this state, the presser foot B is raised so that the positions of the first and second holding shaft portions 31 and 32 of the attachment shaft member A are aligned with the positions of the first and second slits 62*a* and 62*b* of the attachment portion 6 (see FIG. 3B). Subsequently, the terminal member 23 of the attachment shaft member A is pressed in the axial direction or the knob 33 is pulled in the axial direction to move the attachment shaft member A in the axial direction (see FIG. 3C).

As a result, a state in which the first and second positioning shaft portions 21 and 22 protrude from both openings of the through-hole portion 11 is created. Moreover, the first positioning shaft portion 21 is aligned with the position of the first slit 62*a* of the presser foot B and the second positioning shaft portion 22 is aligned with the position of the second slit 62*b*.

Figure 3B:
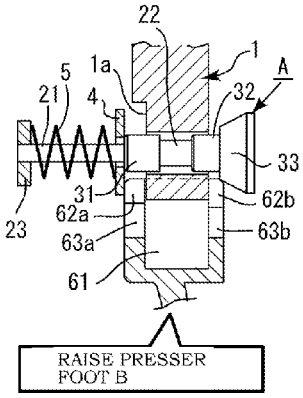
FIG. 3B is a side view of a partial cross-section, illustrating a state in which the presser foot starts to be attached to a lower end of the presser bar.
Figure 3C:
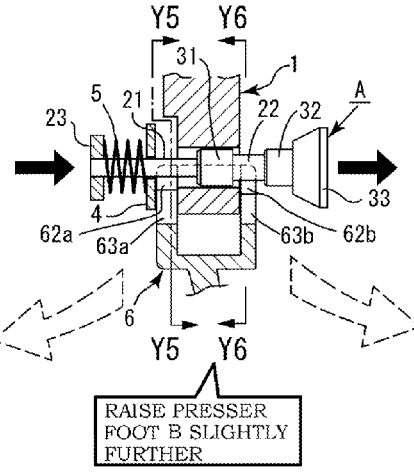
FIG. 3C is a side view of a partial cross-section, illustrating a process in which the attachment shaft member of the presser bar is slid so that first and second positioning shaft portions protrude from the presser bar.
Figure 3D:
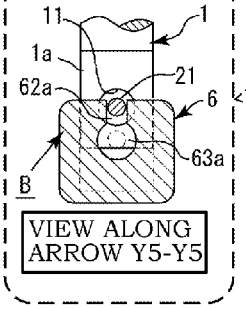
FIG. 3D is a cross-sectional view along arrow Y5-Y5 in FIG. 3C.
Figure 3E:
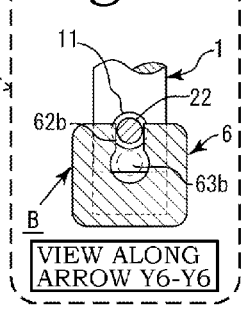
FIG. 3E is a cross-sectional view along arrow Y6-Y6 in FIG. 3C.

In this state, the presser foot B is raised slightly upward and the lower end of the presser bar 1 is inserted in the insertion room 61 of the attachment portion 6 (see FIG. 3B). Further, when the presser foot B is raised slightly, the first positioning shaft portion 21 is inserted in the first slit 62*a* and the second positioning shaft portion 22 is inserted in the second slit 62*b* (see FIGS. 3C, 3D, and 3E).

Figure 4A:
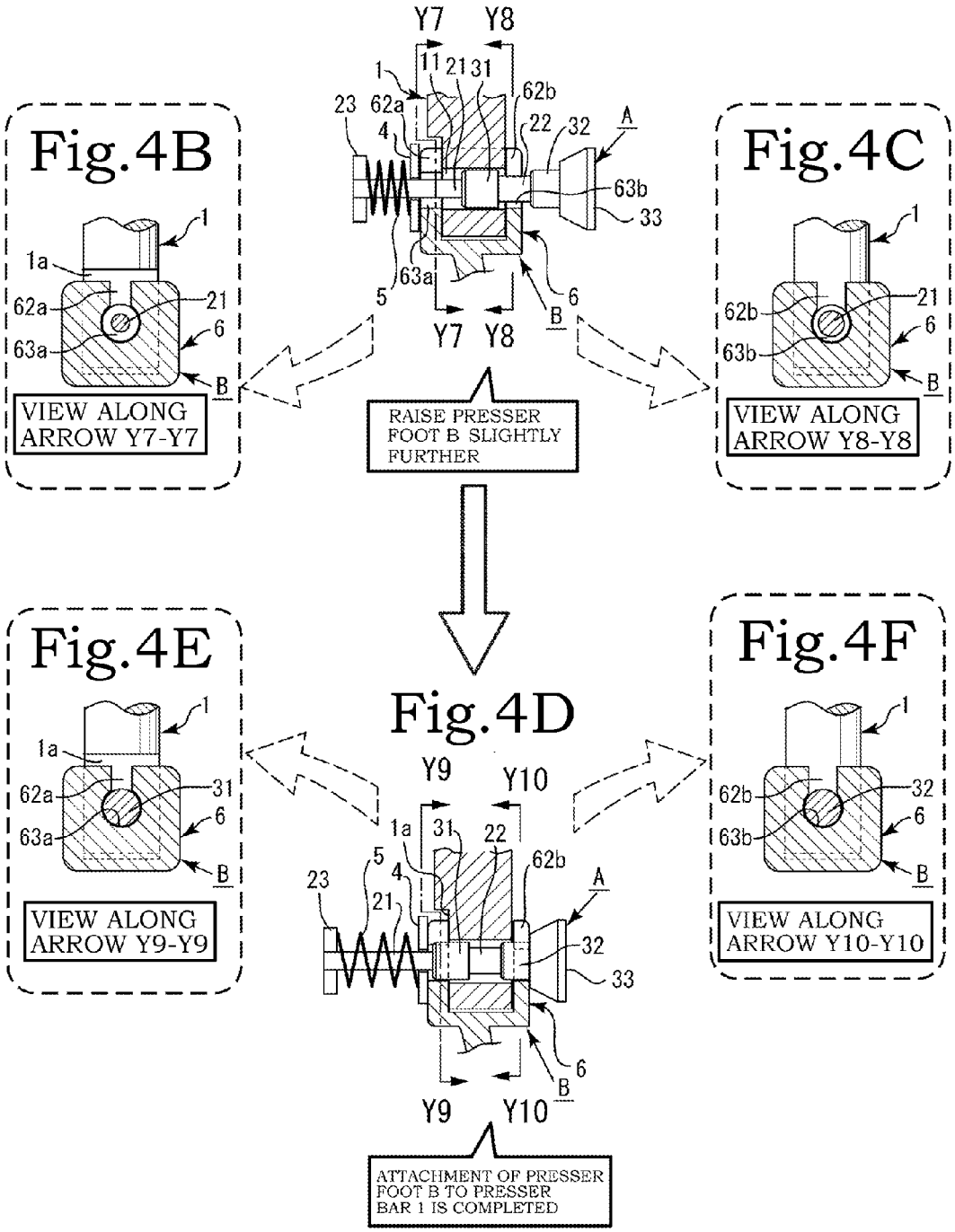
FIG. 4A is a side view of a partial cross-section, illustrating a state in which the first and second positioning shaft portions of the attachment shaft member of the presser bar are disposed at the positions of first and second holding holes of the presser foot.

When the presser foot B is raised slightly further, the first positioning shaft portion 21 reaches the position of the first holding hole 63*a* and the second positioning shaft portion 22 reaches the position of the second holding hole 63*b* (see FIGS. 4A, 4B, and 4C). In this state, the first holding shaft portion 31 can be inserted in the first holding hole 63*a* and the second holding shaft portion 32 can be inserted in the second holding hole 63*b*.

When a user separates his or her hand from the terminal member 23 or the knob 33 of the attachment shaft member A, the first holding shaft portion 31 is inserted in the first holding hole 63*a* and the second holding shaft portion 32 is inserted in the second holding hole 63*b* by the elastic force of the elastic biasing member 5 (see FIGS. 4D, 4E, and 4F). This state is maintained by the elastic biasing member 5 and the attachment of the presser foot B to the presser bar 1 is completed (see FIGS. 4D, 4E, and 4F).

The knob 33 provided at the outer end of the second holding shaft portion 32 of the attachment shaft member A may be formed in a truncated conical shape such that the diameter thereof gradually decreases as it advances from the outer end toward the inner end. Due to such a shape, when the presser foot B is moved upward from the lower side of the presser bar 1, the outer circumferential surface of the knob 33 is inclined and the peripheral wall 61*a* of the attachment portion 6 easily bites into a space between the side surface of the presser bar 1 and the knob 33. Thus, an operation of attaching the presser foot B to the presser bar 1 is made further easier.

Further, the first and second positioning shaft portions 21 and 22 have different diameters, and the first and second slits 62*a* and 62*b* have different configurations corresponding to the different diameters of the first and second positioning shaft portions 21 and 22. Due to such a configuration, the attachment direction of the presser foot B is reliably constant. Due to this, it is possible to prevent an attachment error of the presser foot B to the presser bar 1.

In a third embodiment, the elastic biasing member is configured as a coil spring in which the first positioning shaft portion is inserted in the axial direction. Due to this, a configuration that generates elastic biasing force in the axial direction of the attachment shaft member can be made simple and compact.

In a fourth embodiment, the knob is formed in a truncated conical shape such that a diameter thereof decreases as it advances from an outer end toward an inner end. Due to this configuration, when the presser foot is moved upward from a lower side of the presser bar, a peripheral wall of the attachment portion easily bites into a space between the presser bar and the knob. Thus, an operation of attaching the presser foot to the presser bar is made further easier.

When a washer is provided in the first positioning shaft portion on the inner end side in the axial direction of the coil spring, the washer does not make direct contact with the coil spring but makes surface contact with the presser foot. Thus, a stable fixed state of the presser foot is realized by the elastic member.

What is claimed is:

1. A presser foot for a sewing machine, attached to a lower end of a presser bar to press a fabric during sewing, the presser bar being supported by the sewing machine so as to be slidable in an up-down direction, wherein an attachment shaft member is provided in the presser bar so as to be slidable, the attachment shaft member attaching the presser foot so as to be detachable from the presser bar, an attachment portion is provided in the presser foot so as to be fixed to the lower end of the presser bar by the attachment shaft member, the attachment shaft member includes a holding shaft portion that holds the attachment portion in the presser bar, and two positioning shaft portions, both of which having shaft diameters smaller than that of the holding shaft portion, and an attachment of the presser foot to the presser bar is restricted by providing, in the attachment portion of the presser foot, slits continuous with holding holes in which the holding shaft portion can be inserted and having widths corresponding to the different shaft diameters of the positioning shaft portions of the attachment shaft member.

2. The presser foot for a sewing machine according to claim 1, wherein a first positioning shaft portion, a first holding shaft portion, a second positioning shaft portion, and a second holding shaft portion are continuously formed in the attachment shaft member in that order in an axial direction, a terminal portion is formed at an outer shaft end of the first positioning shaft portion, and a knob is provided at an outer shaft end of the second holding shaft portion, and the slits include a first slit having a width such that the first positioning shaft portion can be inserted, and a second slit having a width such that the second positioning shaft portion can be inserted.

3. The presser foot for a sewing machine according to claim 1, wherein an elastic biasing member is formed as a coil spring in which the first positioning shaft portion is inserted in an axial direction.

4. The presser foot for a sewing machine according to claim 2, wherein the knob is formed in a truncated conical shape such that a diameter thereof decreases as it advances from an outer end toward an inner end.

5. The presser foot for a sewing machine according to claim 2, wherein an elastic biasing member is formed as a coil spring in which the first positioning shaft portion is inserted in an axial direction.

6. The presser foot for a sewing machine according to claim 3, wherein the knob is formed in a truncated conical shape such that a diameter thereof decreases as it advances from an outer end toward an inner end.

7. A presser foot for a sewing machine, attached to a lower end of a presser bar to press a fabric during sewing, the presser bar being supported by the sewing machine so as to be slidable in an up-down direction, wherein an attachment shaft member is provided in the presser bar so as to be slidable, the attachment shaft member attaching the presser foot so as to be detachable from the presser bar, an attachment portion is provided in the presser foot so as to be fixed to the lower end of the presser bar by the attachment shaft member, the attachment shaft member includes a holding shaft portion that holds the attachment portion in the presser bar, and two positioning shaft portions, both of which having shaft diameters smaller than that of the holding shaft portion, and an attachment of the presser foot to the presser bar is restricted by providing, in the attachment portion of the presser foot, slits continuous with holding holes in which the holding shaft portion can be inserted and having widths corresponding to the different shaft diameters of the positioning shaft portions of the attachment shaft member so as to allow the holding shaft portion the ability to freely slide into said corresponding positioning shaft portions, wherein when the attachment shaft member attached to the through-hole portion of the presser bar is moved in the axial direction, the attachment shaft member is operated to a state in which the first and second positioning shaft portions or the first and second holding shaft portions protrude from both openings of the through-hole portion, the attachment portion in which the lower portion of the presser bar is inserted is provided in the presser foot, the first slit in which the first positioning shaft portion only can be inserted and the second slit in which the second positioning shaft portion only can be inserted are formed in the attachment portion, and the first and second holding holes are continuously formed at the lower ends of the first and second slits, respectively.

8. A presser foot for a sewing machine, attached to a lower end of a presser bar to press a fabric during sewing, the presser bar being supported by the sewing machine so as to be slidable in an up-down direction, wherein an attachment shaft member is provided in the presser bar so as to be slidable, the attachment shaft member attaching the presser foot so as to be detachable from the presser bar, an attachment portion is provided in the presser foot so as to be fixed to the lower end of the presser bar by the attachment shaft member, the attachment shaft member includes a holding shaft portion that holds the attachment portion in the presser bar, and two positioning shaft portions, both of which having shaft diameters smaller that that of the holding shaft portion, and an attachment of the presser foot to the presser bar is restricted by providing, in the attachment portion of the presser foot, slits continuous with holding holes in which the holding shaft portion can be inserted and having widths corresponding to the different shaft diameters of the positioning shaft portions of the attachment shaft member so as to allow the holding shaft portion the ability to freely slide into said corresponding positioning shaft portions, wherein when an operation of moving the attachment shaft member in the axial direction is performed, a state in which the first and second positioning shaft portions protrude from the lower end of the presser bar is created, during which the presser foot is raised from a position lower than the lower end of the presser bar while aligning the first slit of the attachment portion of the presser foot with the position of the first positioning shaft portion and aligning the second slit with the position of the second positioning shaft portion.

9. The presser foot for a sewing machine according to claim 1, wherein a diameter of a first positioning shaft portion is a same as a diameter of a second positioning shaft portion.

10. The presser foot for a sewing machine according to claim 1, wherein a diameter of a first positioning shaft portion is different than a diameter of a second positioning shaft portion.

* * * * *